US007197258B2

(12) United States Patent
Ahn et al.

(10) Patent No.: US 7,197,258 B2
(45) Date of Patent: Mar. 27, 2007

(54) DEVELOPING CARTRIDGE AND AN ELECTROPHOTOGRAPHIC IMAGE FORMING APPARATUS HAVING THE SAME

(75) Inventors: Byung-sun Ahn, Suwon-si (KR); Sang-cheol Park, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 3 days.

(21) Appl. No.: 10/957,638

(22) Filed: Oct. 5, 2004

(65) Prior Publication Data

US 2005/0111876 A1 May 26, 2005

(30) Foreign Application Priority Data

Nov. 25, 2003 (KR) ..... 10-2003-0084200

(51) Int. Cl.
*G03G 15/08* (2006.01)

(52) U.S. Cl. ..... 399/103

(58) Field of Classification Search ..... 399/103, 399/98, 99, 102, 104, 105, 106
See application file for complete search history.

(56) References Cited

U.S. PATENT DOCUMENTS 5,802,441 A 9/1998 Okada
6,009,287 A * 12/1999 Goldie ..... 399/103
6,101,352 A 8/2000 Hashimoto et al.
6,137,970 A * 10/2000 Sasago ..... 399/106
2003/0161644 A1* 8/2003 Yokoi et al. ..... 399/27

FOREIGN PATENT DOCUMENTS

JP 11-249399 9/1999
JP 11-305546 11/1999
JP 2000-162857 6/2000

* cited by examiner

*Primary Examiner*—Sandra L. Brase
(74) *Attorney, Agent, or Firm*—Stanzione & Kim, LLP

(57) ABSTRACT

A developing cartridge includes a casing having a toner chamber, a feeding roller installed within the toner chamber, a developing roller supplied with a toner from the feeding roller, and a sealing film interposed between the developing roller and the feeding roller. The sealing film blocks a movement of the toner toward a gap between the developing roller and a bottom of the toner chamber, so that the toner does not leak out through the gap between the developing roller and the bottom of the toner chamber.

18 Claims, 8 Drawing Sheets

DEVELOPING CARTRIDGE AND AN ELECTROPHOTOGRAPHIC IMAGE FORMING APPARATUS HAVING THE SAME

CROSS-REFERENCE TO RELATED APPLICATIONS

This application claims the benefit of Korean Application No. 2003-84200, filed Nov. 25, 2003, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to a developing cartridge and an electrophotographic image forming apparatus equipped with the same.

2. Description of the Related Art

A general electrophotographic image forming apparatus prints a desired image through a process in which a photosensitive medium is exposed in a predetermined pattern to form an electrostatic latent image, a developer is deposited on the electrostatic latent image, and the developed image is transferred onto a paper.

FIG. 1 schematically shows a conventional electrophotographic image forming apparatus 100.

As shown in FIG. 1, the conventional electrophotographic image forming apparatus 100 comprises an exposure device 110, a developing cartridge 120, a fixing device 140, and a paper feeding device 150. When a printing signal is externally inputted, the exposure device 110 illuminates a laser beam onto a photosensitive drum 124 (FIG. 2) in such a way that an electrostatic latent image is formed on a surface of the photosensitive drum 124. The electrostatic latent image formed in this manner is developed by toner into a toner image, and the toner image on the photosensitive drum 124 is transferred by a transfer roller 130 onto a paper fed from the paper feeding device 150. Then, the transferred toner image is fused on the paper when the paper passes through the fixing device 140.

The developing cartridge 120 is a kind of consumables having a limited lifespan and detachably mounted on an image forming apparatus body 160. FIG. 2 schematically illustrates the conventional developing cartridge 120. Referring to FIG. 2, the conventional developing cartridge 120 comprises a casing 121, a toner storage chamber 121*a*, a toner feeding chamber 121*b*, a developing roller 122, a feeding roller 123, a photosensitive drum 124, an electrification roller 125, and a waste toner collecting chamber 121*c*. The storage chamber 121*a* fluidly communicates with the toner feeding chamber 121*b*, and the toner feeding chamber 121*b* is open to allow a toner to move to the photosensitive drum 124. In addition, an opening formed between the toner feeding chamber 121*b* and the photosensitive drum 124 is closed by the developing roller 122, a restraint blade 126 and a shielding blade 127. However, the shielding blade 127 is apt to be deformed by pressure of toner charged in the toner feeding chamber 121*b* and the toner storage chamber 121*a*. Further, if an impact is applied to the developing cartridge 120 or vibration occurs in the developing cartridge 120, a gap is formed between the developing roller 122 and the shielding blade 127, through which the toner may leak out. Due to this problem, the conventional developing cartridge 120 is marketed in a state that a shielding member 128 closes the toner storage chamber 121*a*.

However, with the conventional developing cartridge 120, since a space for storing toner is limited to the interior of the toner storage chamber 121*a* defined by the shielding member 128, the toner storage quantity is restricted. As a result, the developing cartridge 120 needs to be often replaced. Furthermore, since components of a developing cartridge, such as the photosensitive drum 124 and the developing roller 122, are being improved in endurance recently, accommodation of the toner needs to be improved in order to lengthen a life span of the developing cartridge 120.

In order to solve this problem, the size of the toner storage chamber 121*a* may be enlarged. However, it is not a desirable method because an image forming apparatus body should be also increased.

SUMMARY OF THE INVENTION

In order to solve the above and/or other problems, it is an aspect of the present general inventive concept to provide a developing cartridge capable of increasing a toner storage space without changing a size and construction of a developing cartridge so largely, and an electrophotographic image forming apparatus equipped with the same.

Additional aspects and advantages of the present general inventive concept will be set forth in part in the description which follows and, in part, will be obvious from the description, or may be learned by practice of the general inventive concept.

The above and/or other aspects of the present general inventive concept may be achieved by providing a developing cartridge comprising a casing having a toner chamber, a feeding roller installed within the toner chamber, a developing roller supplied with a toner from the feeding roller, and a sealing film interposed between the developing roller and the feeding roller.

In an aspect of the present general inventive concept, the casing may have a toner chamber and an opening, and the developing roller can be installed in the opening. In addition, the sealing film can be interposed between the developing roller and the feeding roller and extended to a bottom of the toner chamber.

In another aspect of the present general inventive concept, a through-hole can be formed at one side of the bottom of the toner chamber, and one end of the sealing film can be exposed to an outside of the casing through the through-hole.

In yet another aspect of the present general inventive concept, a handle may be connected to the one end of the sealing film and detachably attached to a part of the outside of the casing.

In still another aspect of the present general inventive concept, the sealing film may comprise a contact part disposed between the developing roller and the feeding roller, a shielding part extended from the contact part to the through-hole, and a connection part extended from the shielding part and connected to the handle.

In an other aspect of the present general inventive concept, at least one of the outside and an inside of the casing may be provided with a sealing member to seal the through-hole.

In another aspect of the present general inventive concept, the bottom of the toner chamber may be provided with a shielding blade extended to the developing roller so as to shield the opening in cooperation with the developing roller.

In another aspect of the present general inventive concept, the developing cartridge according to an embodiment of the present invention may further comprise a restraint blade installed in the casing through the opening to shield the opening in cooperation with the developing roller.

In another aspect of the present general inventive concept, the developing cartridge further comprises a photoconductive body to which the toner developed by the developing roller is deposited.

The above and/or other aspects of the present general inventive concept may also be achieved by providing an electrophotographic image forming apparatus comprising a casing having a toner chamber, a feeding roller installed within the toner chamber, a developing roller supplied with a toner from the feeding roller, a photoconductive body on which the toner developed by the developing roller is deposited, a transfer roller to transfer the toner deposited on the developing roller onto a fed paper, a sealing film interposed between the developing roller and the feeding roller, a sealing film detection device to detect the sealing film by sensing the exposed part of the sealing film, and a control device to control the respective components, thereby controlling a printing operation.

In an aspect of the present general inventive concept, the casing, the feeding roller, the developing roller and the sealing film may form a developing cartridge, and the casing can be provided with the toner chamber to be charged with toner. The sealing film can be extended from a contact portion between the developing roller and the feeding roller to a hole formed at one side of a bottom of the case of the developing cartridge so as to prevent the toner stored in the toner chamber from moving through a gap between the developing roller and the toner chamber.

In another aspect of the present general inventive concept, the control device can control the respective components of the image forming apparatus so that the printing operation cannot be performed when the sealing film detection device detects the sealing film of the developing cartridge.

In yet another aspect of the present general inventive concept, the electrophotographic image forming apparatus may further comprise a display device to display information on the sealing film when the sealing film detection device senses the sealing film.

In still another aspect of the present general inventive concept, the sealing film may comprise a shielding part disposed in the gap, a connection part extended from the shielding part, and a handle connected to an end of the connection part, and the sealing film detection device detects the sealing film by sensing the handle.

In another aspect of the present general inventive concept, the sealing film detection device may comprise a sensing bar of which position is variable by the handle.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
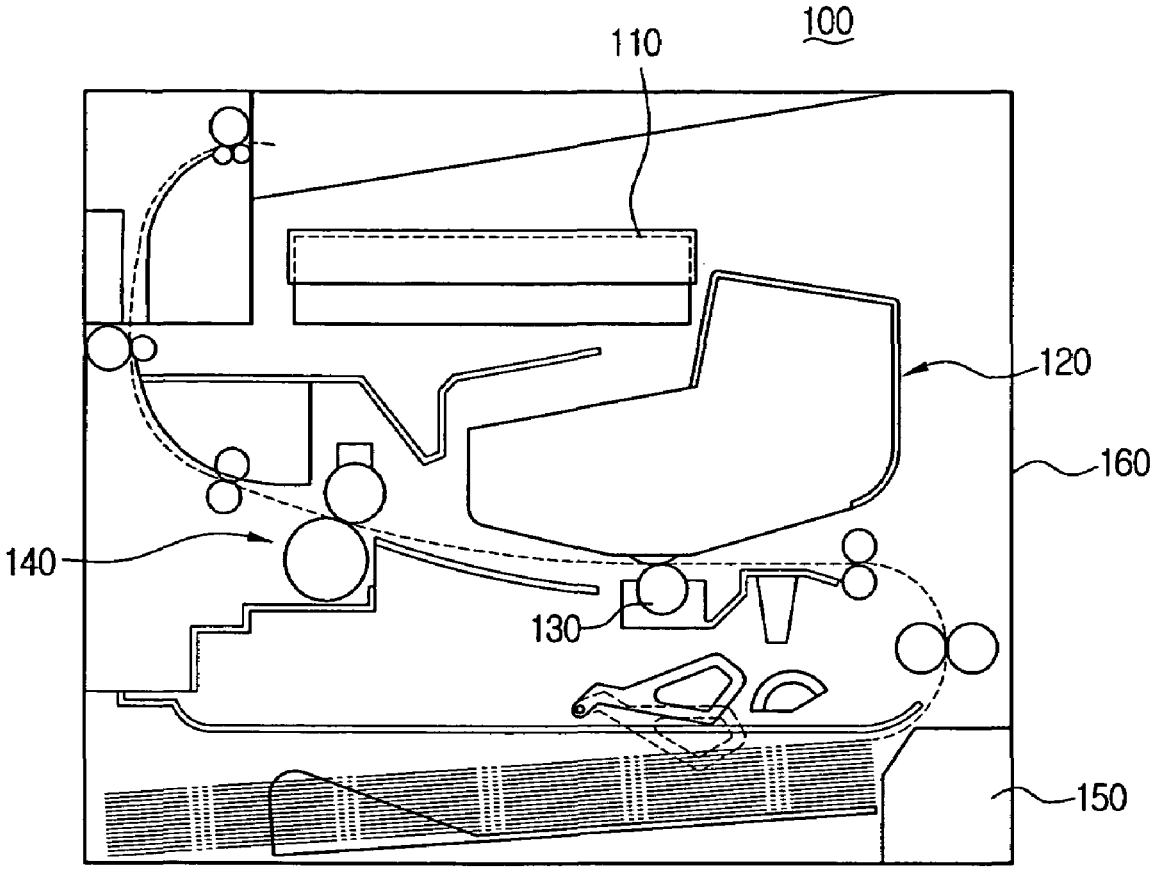
FIG. 1 (PRIOR ART)
FIG. 1 schematically shows a conventional electrophotographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
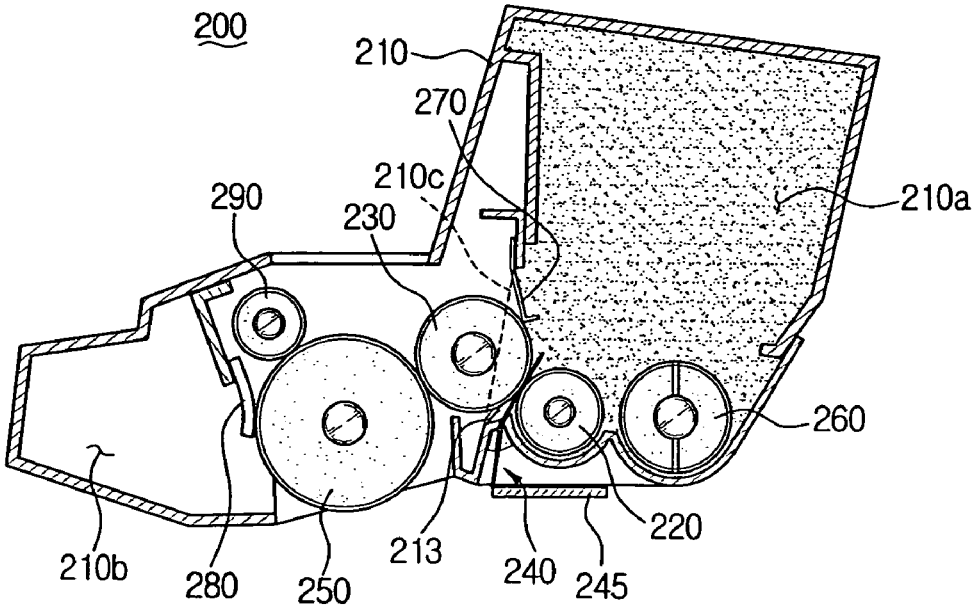
FIG. 3 schematically shows a developing cartridge according to an embodiment of the present general inventive concept.
Figure 4:
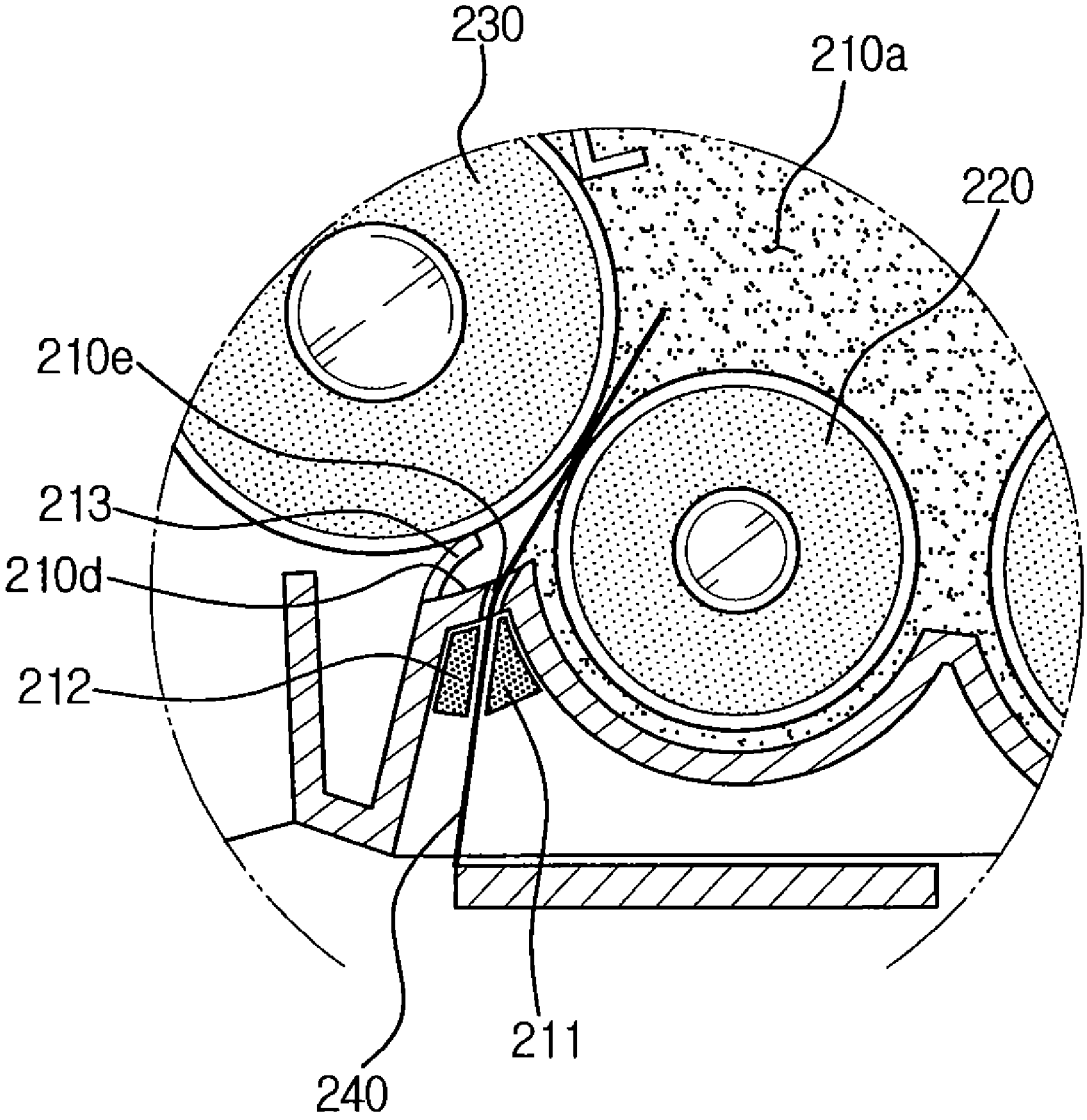
FIG. 4 is an enlarged view showing a main structure of the developing cartridge shown in FIG. 3.

As shown in FIGS. 3 and 4, a developing cartridge 200 according to an embodiment of the present general inventive concept may comprise a casing 210, a feeding roller 220, a sealing film 240 and a photosensitive drum 250.

Figure 2:
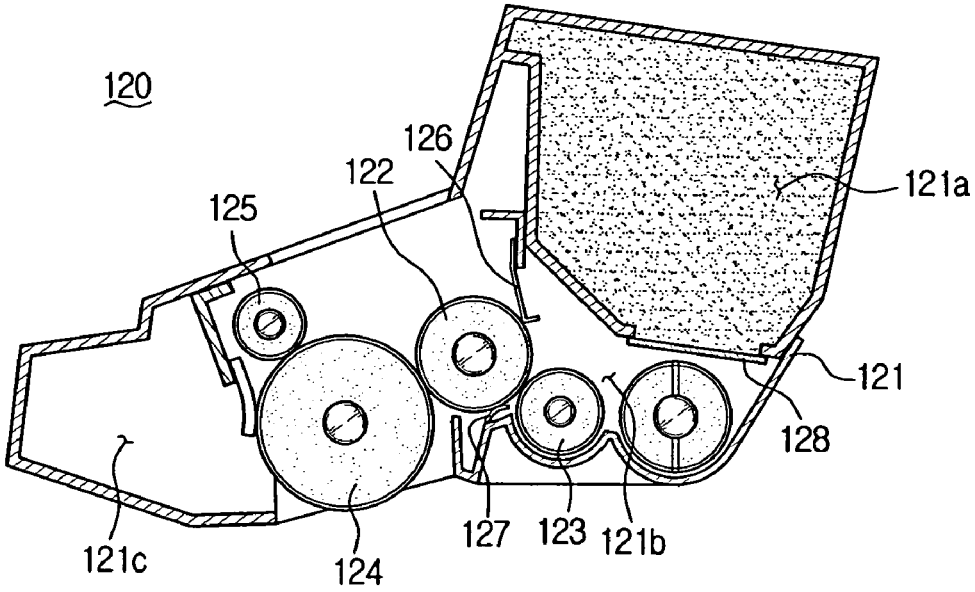
FIG. 2 (PRIOR ART)
FIG. 2 schematically shows a conventional developing cartridge of the conventional developing cartridge.

The interior of the casing 210 can be provided with a toner chamber 210*a* to store toner in one side thereof and a waste toner collecting chamber 210*b* formed in the other side and a toner feeding chamber 121*b* of a conventional developing cartridge 120 shown in FIG. 2, and the toner chamber 210*a* can be charged with the toner. An opening 210*c* can be formed on one side of the casing 210 to allow the toner stored within the toner chamber 210*a* to be outwardly discharged from the toner chamber 210*a*. In addition, the lower part of the toner chamber 210*a* can be provided with a stirrer 260 to stir the toner in order to prevent the toner from conglomerating.

Further, as shown in FIG. 4, a thorough-hole 210*e* can be formed in one side of the bottom of the toner chamber 210*a*, and first and second sealing members 211 and 212 can be provided on one side of a lower part of the casing 210 so as to seal the through-hole 210*e*. The sealing members 211 and 212 can prevent the toner within the toner chamber 210*a* from leaking out through the through-hole 210*e*, after the sealing film 240 has been escaped from the through-hole 210*e*. In particular, the first sealing member 211 can also clean out the toner deposited on a side of the sealing film 240 when the sealing film 240 escapes from the through-hole 210*e* as well as can seal the through-hole 210*e*. Although two sealing members, such as the first and second sealing members 211 and 212, are provided in this embodiment, it is possible to provide only one of the first and second sealing members 211 and 212 according to an aspect of the present general inventive concept.

The feeding roller 220 can deposit the toner onto a surface of the developing roller 230 while rotating in contact with the developing roller 230, wherein the feeding roller 220 is rotationally installed in the lower part of the toner chamber 210*a*.

The developing roller 230 can be installed in the opening 210*c* of the toner chamber 210*a* to be biased toward an outside of the toner chamber 210*a*, and can be close contact with the feeding roller 220. A restraint blade 270 can be provided on an upper side of the surface of the developing roller 230 to restrain a thickness of a toner layer deposited on the surface of the developing roller 230. The restraint blade 270 can also serve to shield an upper part of the opening 210*c* in cooperation with the developing roller 230. In addition, a shield blade 213 can be provided to be in contact with a lower side of the surface of the developing roller 230. The shielding blade 213 can shield a lower part of the opening 210*c* in cooperation with the developing roller 230.

Figure 5A:
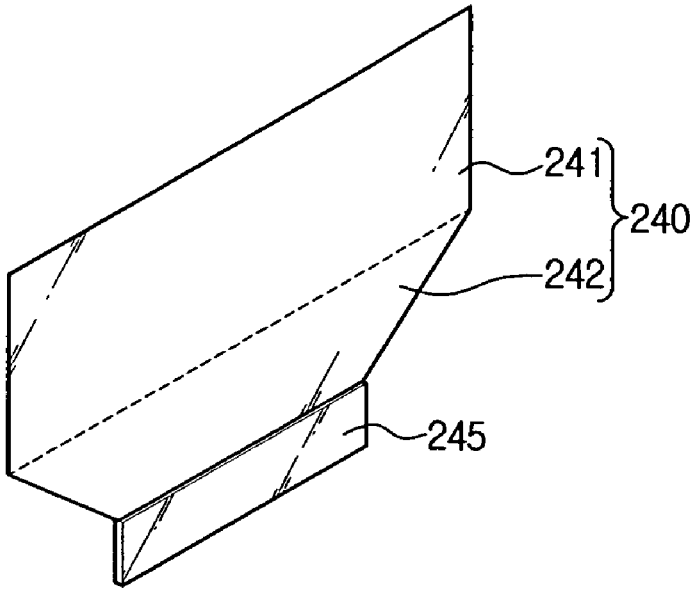
FIG. 5A is a perspective view of a shield film according to another embodiment of the present general inventive concept.
Figure 5B:
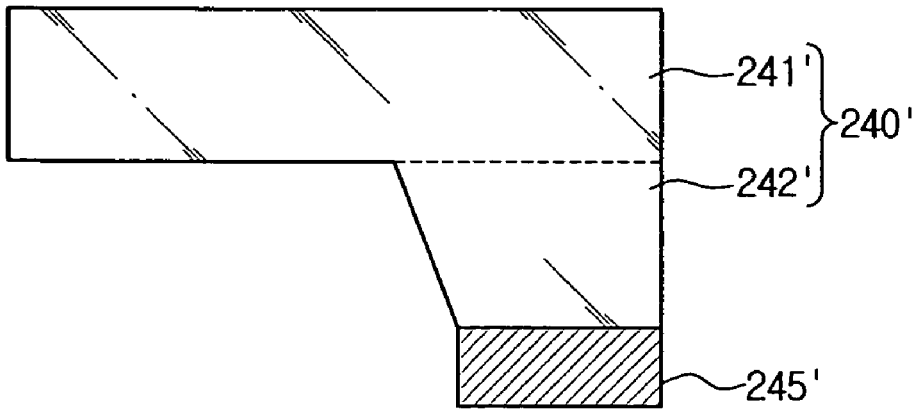
FIG. 5B shows a sealing film according to another embodiment of the present general inventive concept.

The sealing film 240 may comprise a shielding part 241 and a connection part 242, as shown in FIGS. 5A and 5B. In addition, a handle 245 can be connected to one end of the sealing film 240. As shown in FIG. 4, the shielding part 241 is interposed between the developing roller 230 and the feeding roller 220 and extended from the connection part 242 between the developing roller 230 and the feeding roller 220 through the through-hole 210*e* formed on a side 210*d* of the bottom of the casing 210. Therefore, the shielding part 241 can block a movement of the toner in such a way that the toner cannot move to the shielding blade 213. Thus, the shielding blade 213 can block the leakage of the toner from the casing 210. As shown in FIGS. 5A and 5B, the connection part 242 can be extended from the shielding part 241 and has a width narrower than that of the shielding part 241. The connection part 242 can connect the shielding part 241 and the handle 245. The handle 245 can be connected to an end of the connection part 242 and detachably attached to an outside of the lower part of the casing 210 (FIG. 3), so that the handle 245 does not interfere with carrying or handling of the developing cartridge 200. The handle 245 can be installed for a user's convenience when the user removes the sealing film 240, however, is not an essential element. If there is no problem in grasping an exposed part of the sealing film 240 and pulling out the sealing film 240, the handle 245 may not be provided.

The sealing film 240 can also prevent migration between the developing roller 230 and the feeding roller 220, besides blocking the movement of the toner toward the shielding blade 213. More specifically, when the developing cartridge 200 is placed in a certain circumstance of temperature, humidity or pressure, a certain molecular element of the developing roller 230 and the feeding roller 220 can move to and can affect a mating roller, and in particular, a horizontal band can be formed on one or both of two rollers 220 and 230 in a nip through which the two rollers 220 and 230 are in contact with each other to cause fatal deterioration of the quality of a printed image. The sealing film 240 according to this embodiment can shield the nip between the feeding roller 220 and the developing roller 230 to prevent the movement of the molecular element, thereby preventing the migration.

Figure 7:
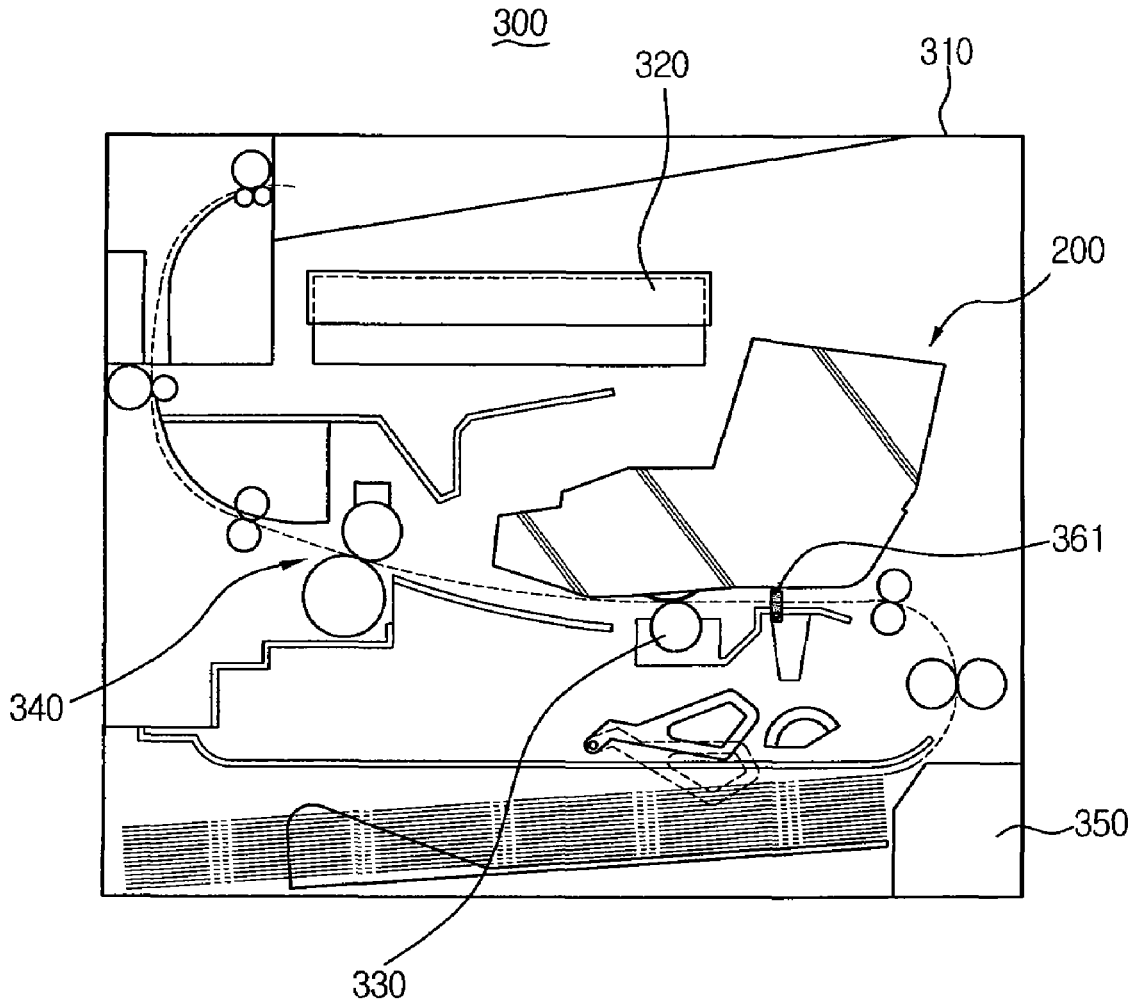
FIG. 7 schematically shows a structure of an electrophotographic image forming apparatus installed with the developing cartridge of FIG. 3 according to another embodiment of the present general inventive concept.

FIG. 7 shows an electrophotographic image forming apparatus 300 installed with the developing cartridge 200 of FIG. 3 according to another embodiment of the present general inventive concept. When the casing 210 is installed in an image forming apparatus body 310 (FIG. 7), the shielding part 241 can be extracted and removed from a shield position between the developing roller 230 and the feeding roller 220. The shielding part 241 may be formed of a paper or a high molecular material, such as urethane, polyethylene, polypropylene, or other various types of thin and durable materials. In addition, the handle 245 can be made by a mold or a press and can have a thickness to be conveniently handled by a user.

The sealing film 240 may have various shapes other than that shown in FIG. 5A. For example, it may have the shape as shown in FIG. 5B. The sealing film 240' may also include a shielding part 241' and a connection part 242', and a handle 245' may be connected to the connection part 242'.

Figure 6:
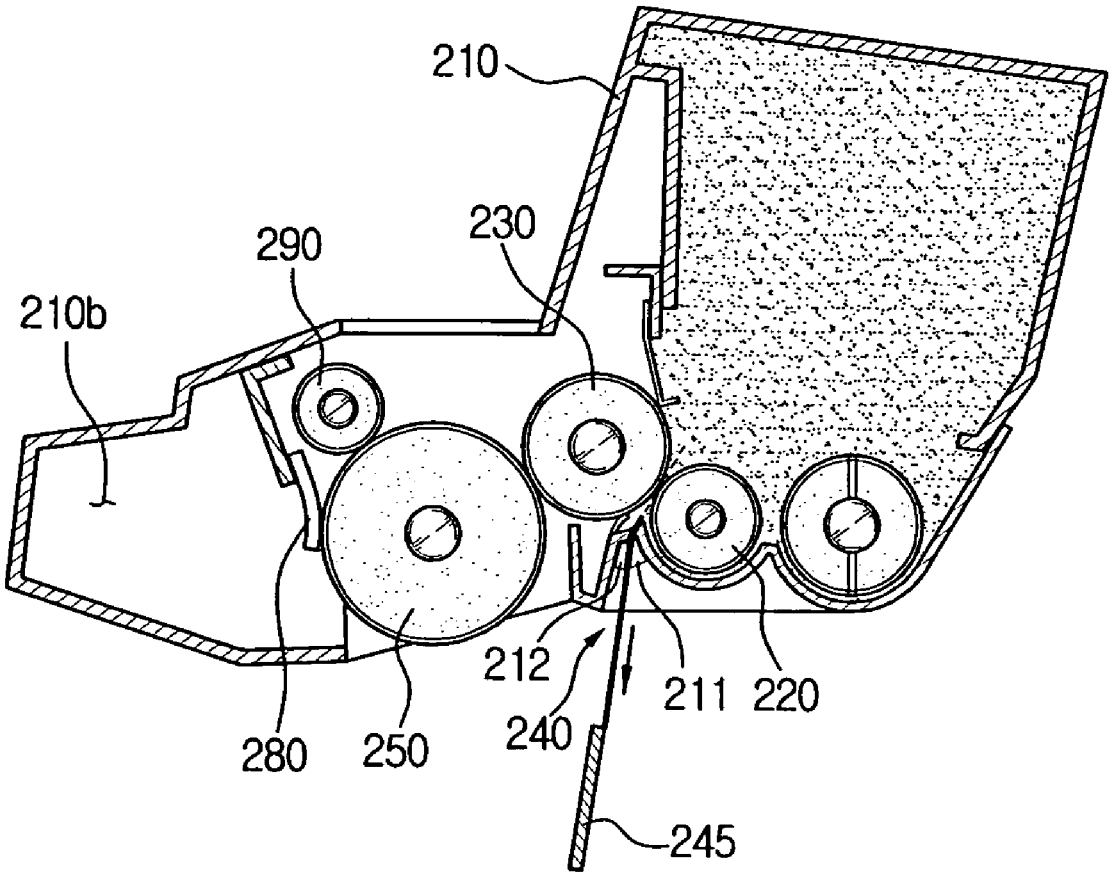
FIG. 6 shows an operation of removing of a sealing film of a developing cartridge according to another embodiment of the present general inventive concept.

The sealing film 240 can be removed before the developing cartridge 200 is installed in the image forming apparatus body 310. FIG. 6 shows an operation of removing the sealing film. In the removing operation, the user detaches and downwardly draws the handle 245 attached to a part of the lower side of the casing 210. At this time, the sealing film 240 can be extracted and removed from the shielding position between the developing roller 230 and the feeding roller 220. When the sealing film 240 is extracted outwardly of the casing 210, a side of the sealing film 240 sustained with the toner can come in contact with the first sealing member 211. Therefore, the toner sustained on the sealing film 240 can be wiped away by the first sealing member 211.

The photosensitive drum 250 can be installed to be in contact or non-contact with the developing roller 230 such that the photosensitive drum 250 receives the toner fed from the developing roller 230. One side of the surface of the photosensitive drum 250 can contact a cleaning blade 280 to remove the toner remaining on a surface of the photosensitive drum 250 after a transferring process has been performed. The remaining toner removed by the cleaning blade 280 can be collected into the waste toner collecting chamber 210*b*.

In addition, an electrification roller 290 can be installed within the casing 210 to electrify the photosensitive drum 250.

As described above, the developing cartridge 200 according to the above embodiment of the present general inventive concept employs the sealing film 240 removably interposed between the developing roller 230 and the feeding roller 220, and therefore, a toner storage space can be increased without changing a size or construction of the developing cartridge 200.

Figure 8:
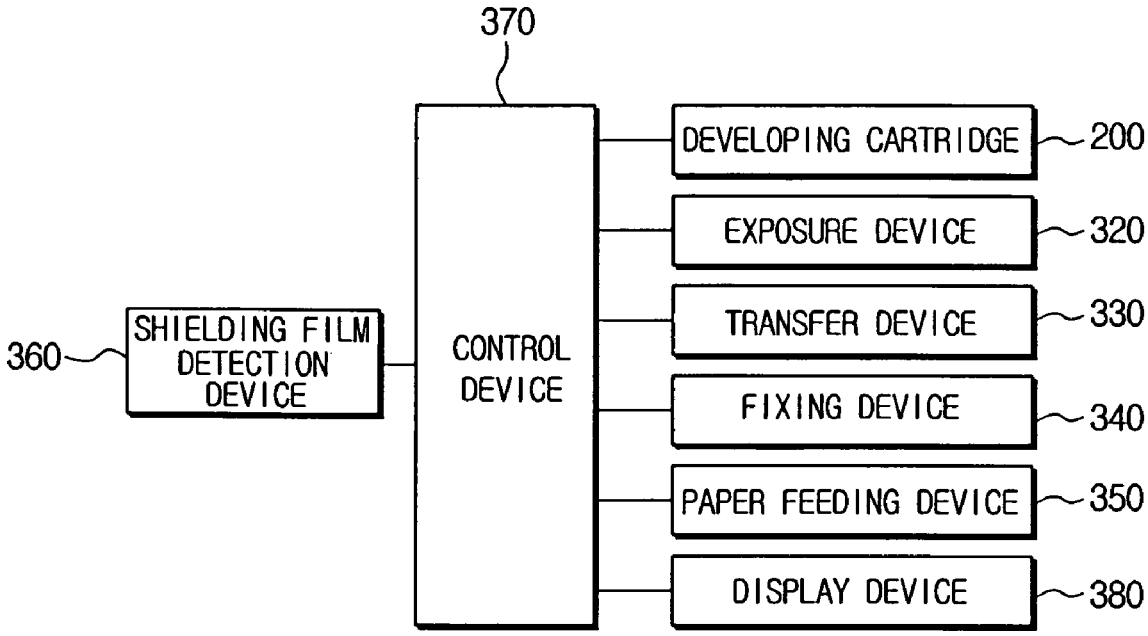
FIG. 8 is a block diagram schematically showing an operation of an electrophotographic image forming apparatus according to another embodiment of the present general inventive concept.

As shown in FIGS. 7 and 8, the electrophotographic image forming apparatus 300 according to another embodiment of the present general inventive concept may have the developing cartridge 200 as described above, and also comprise an image forming apparatus body 310, an exposure device 320, a transfer device 330 having a transfer roller, a fixing device 340, a paper feeding device 350, a sealing film detection device 360, a control device 370, and a display device 380.

The developing cartridge 200 can be constructed as described above and may comprise a casing 210, a toner chamber 210*a*, a stirrer 260, a feeding roller 220, a developing roller 230, a restraint blade 270, a shielding blade 213, a sealing film 240, a photosensitive drum 250, a cleaning blade 280, a waste toner collecting chamber 210*b*, and an electrification roller 290 as shown in FIGS. 3–6. The casing 210 is provided with a through-hole 210*e* (FIG. 4) and first and second sealing members 211 and 212 (FIG. 4). A handle 245 can be connected to an end of the sealing film 240, in which the handle 245 is detachably attached to the outside of the casing 210. The construction of such a developing cartridge 200 of FIG. 7 is the same as that described above in FIGS. 3 to 6, and detailed description thereof is omitted.

The sealing film detection device 360 can detect whether the sealing film 240 of the developing cartridge 200 is removed or not, and can comprise a sensing bar 361 installed below a position where the developing cartridge 200 is mounted, in the image forming apparatus body 310. The sealing film detection device 360 can sense the handle 245 attached to an outside of the casing 210, and sends a corresponding signal to the control device 370.

The sealing film detection device 360 is not limited to the construction provided with the sensing bar 361, and the sealing film detection device 360 can mechanically operate in such a manner that the sealing film detection device 360 may comprise an optical sensor or another electric sensor to detect the existence of the sealing film 240. In addition, the sealing film detection device 360 is arranged in such a manner that when the sealing film 240 is not connected to the handle 245, the sealing film detection device 360 can sense the exposed part of the sealing film 240.

The control device 370 can control various components of the image forming apparatus 300, thereby controlling the entire operation of the image forming apparatus 300 including a printing operation. In particular, the control device 370 can control the components of the image forming apparatus 300 in such a way that when the developing cartridge 200 is mounted without removing the sealing film 240, the printing operation cannot be performed.

Figure 9:
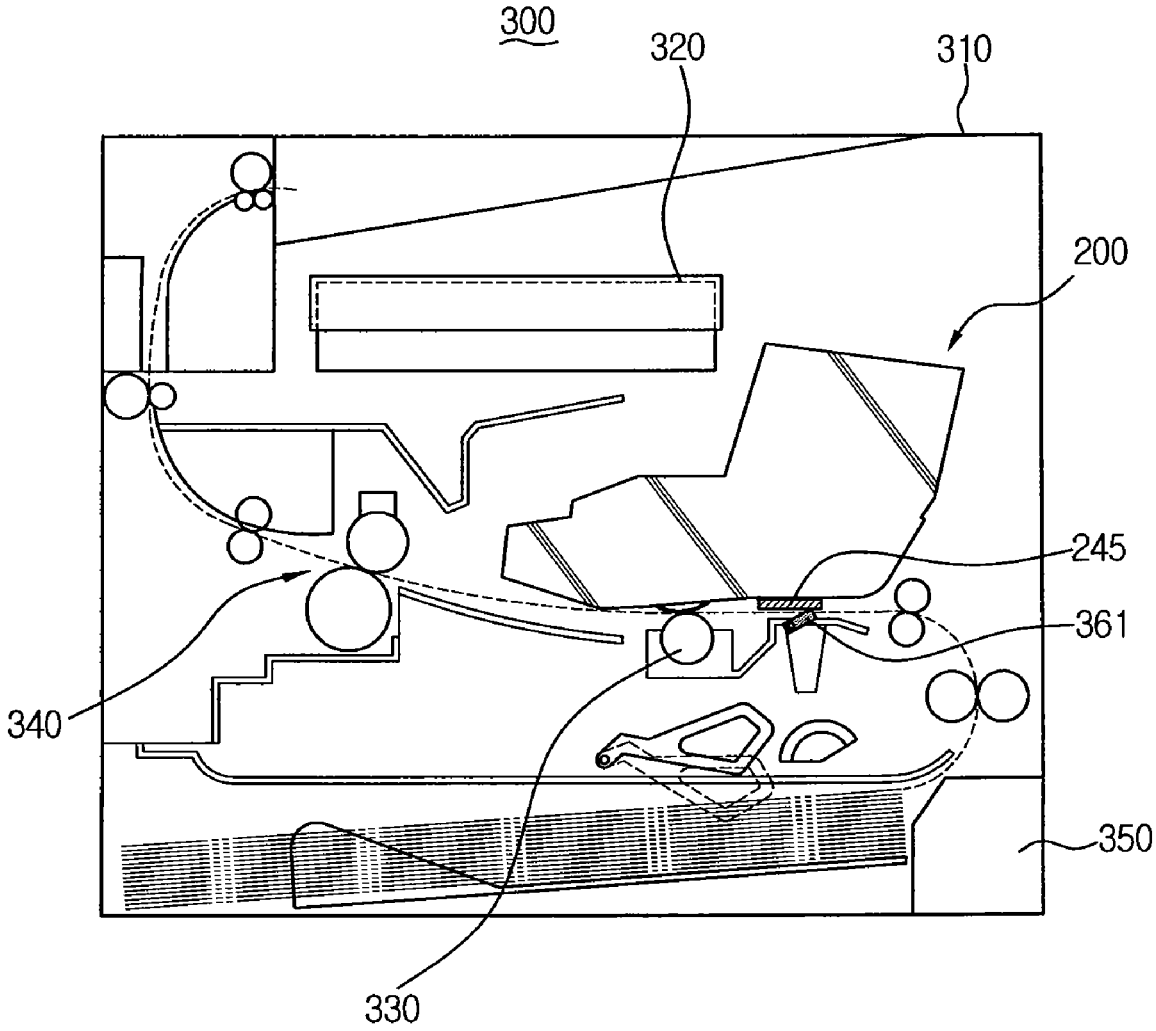
FIG. 9 is a view showing a structure of an electrophotographic image forming apparatus according to another embodiment of the present general inventive concept.

The components of the image forming apparatus of FIG. 7 or 9, such as the exposure device 320, the transfer roller 330, the fixing device 340 and the paper feeding device 350, may be not different from a conventional image forming apparatus. Therefore, detailed description thereof is omitted.

Hereinbelow, an operation of the electrophotographic image forming apparatus 300 according to another embodiment of the present general inventive concept will be described with reference to FIGS. 7 to 9.

As shown in FIG. 7, when the developing cartridge 200 is mounted in the image forming apparatus body 310 in the state in which a sealing film 240 (FIG. 3) and a handle 245 are removed, the sensing bar 361 of the sealing film detection device 360 (FIG. 8) can be maintained in its original position. Therefore, the sealing film detection device 360 does not generate a signal, and the control device 370 (FIG. 8) can control the components of the image forming apparatus 300 so that the printing operation is normally performed.

However, if the developing cartridge 200 is mounted in the image forming apparatus body 310 in a state in which the sealing film 240 (FIG. 3) and the handle 245 are not removed, as shown in FIG. 9, the handle 245 can push the sensing bar 361 to be tilted. In this case, the sealing film detection device 360 (FIG. 8) can send the signal concerning the sealing film to the control device 370. If the sealing film 240 is not removed from the developing cartridge 200, the toner charged in the toner chamber 210 (FIG. 3) can not be fed, and therefore, the printing operation is not performed. Accordingly, the control device 370 can control the components of the image forming apparatus 300 so that the printing operation cannot be performed. The control device 370 can display a message requesting the removal of the sealing film 240 on the display device 380 (FIG. 8). The control device may generate a warning signal according to the signal of the sealing film detection device 360.

Accordingly, the image forming apparatus 300 may not unnecessarily operate.

As described above, according to the embodiment of the developing cartridge 200, since the sealing film 240 removably interposed between the developing roller 230 and the feeding roller 220 prevents the leakage of the toner, the toner storage chamber 121*a* and the toner feeding chamber 121*b* do not have to be separately provided. Therefore, an additional toner storage space can be additionally guaranteed by charging with the toner a space corresponding to a toner feeding chamber 121*b* of FIG. 2 without changing the construction of the developing cartridge 200.

In addition, according to the embodiments of the present general inventive concept, the migration of the toner between the developing roller 230 and the feeding roller 220 can be prevented since the sealing film 240 is interposed between the developing roller 230 and the feeding roller 220.

Meanwhile, according to an aspect of the electrophotographic image forming apparatus 300, since the printing operation of the image forming apparatus 300 is not performed if the sealing film 240 installed in the developing cartridge 200 is not removed, waste of electric power and breakdown of the image forming apparatus caused by an unnecessary operation of the apparatus can be avoided.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing cartridge comprising:

a casing having a toner chamber;

a feeding roller installed within the toner chamber;

a developing roller supplied with a toner from the feeding roller; and a sealing film interposed between the developing roller and the feeding roller, wherein the toner chamber comprises a space having a boundary defined by the casing, the feeding roller, the developing roller, and the sealing film to contain the toner.

2. The developing cartridge according to claim 1, wherein the casing comprises a through-hole formed on a bottom of the toner chamber, and an end of the sealing film is exposed to an outside of the casing through the through-hole.

3. The developing cartridge according to claim 2, wherein the sealing film comprises a handle connected to the end of the sealing film.

4. The developing cartridge according to claim 3, wherein the handle is detachably attached to the outside of the casing.

5. The developing cartridge according to claim 3, wherein the sealing film comprises:

a shielding part extended from a contact part between the developing roller and the feeding roller; and a connection part extended from the shielding part and connected to the handle.

6. The developing cartridge according to claim 2, wherein at least one of the inside and the outside of the casing comprises a sealing member to seal the through-hole.

7. The developing cartridge according to claim 1, further comprising:

a shielding member extended from a bottom of the toner chamber to contact the developing roller so as to shield an opening of the casing in cooperation with the developing roller.

8. The developing cartridge according to claim 1, further comprising:

a restraint blade installed in an opening of the casing to shield the opening in cooperation with the developing roller.

9. The developing cartridge according to claim 1, wherein the developing cartridge further comprises a photoconductive body on which the toner developed by the developing roller is deposited.

10. An electrophotographic image forming apparatus comprising:

a casing having a toner chamber;

a feeding roller installed within the toner chamber;

a developing roller supplied with a toner from the feeding roller;

a photoconductive body to which the toner developed by the developing roller is deposited;

a transfer roller to transfer the toner deposited on the developing roller onto a fed paper;

a sealing film interposed between the developing roller and the feeding roller;

a sealing film detection device to detect the sealing film by sensing an exposed part of the sealing film; and a control device to control components of the image forming apparatus and to control a printing operation.

11. The electrophotographic image forming apparatus according to claim 10, wherein the control device controls the components of the image forming apparatus so that the printing operation cannot be performed when the sealing film detection device detects the sealing film of the developing cartridge.

12. The electrophotographic image forming apparatus according to claim 10, further comprising:

a display device to display information on the sealing film when the sealing film detection device senses the sealing film.

13. The electrophotographic image forming apparatus according to claim 10, wherein the sealing film comprises a handle connected to an end of the exposed part, and the sealing film detection device detects the sealing film by sensing the handle.

14. The electrophotographic image forming apparatus according to claim 13, wherein the sealing film detection device comprises a sensing bar of which the position is variable by a location of the handle with respect to the casing.

15. An image forming apparatus comprising:

an image forming apparatus body;

a developing cartridge removably installable in the image forming apparatus body, and comprising a casing having a toner chamber filled with a toner and having an opening formed on the toner chamber, a feeding roller disposed in the toner chamber, a developing roller disposed in the opening of the toner chamber to communicate with the feeding roller, and a sealing film to prevent migration of the toner from the feeding roller to the developing roller;

a sealing film detection device to detect the sealing film exposed from the developing cartridge to generate a detection signal; and a control device to control a printing operation according to the detection signal.

16. The image forming apparatus according to claim 15, wherein the image forming apparatus comprises a transfer roller and a paper feeding device, and the sealing film detection device is disposed between the transfer roller and the paper feeding device.

17. The image forming apparatus according to claim 15, wherein the toner chamber comprises a through-hole through which the sealing film is inserted into the toner chamber and exposed to an outside of the toner chamber, and the sealing film detection device is disposed on a position of the image forming apparatus body to correspond to a portion of the sealing film exposed through the through-hole of the toner chamber.

18. The image forming apparatus according to claim 15, wherein the sealing film detection device comprises an optical sensing unit to optically detect a portion of the sealing film, and the portion of the sealing film has a reflection characteristic different from that of the developing cartridge.

* * * * *